US011994327B2

(12) United States Patent
Rozsnaki et al.

(10) Patent No.: US 11,994,327 B2
(45) Date of Patent: May 28, 2024

(54) HEATING AND COOLING SYSTEMS

(71) Applicant: Copeland LP, Sidney, OH (US)

(72) Inventors: Joseph J. Rozsnaki, Troy, OH (US); Donald R. Wiesmann, Troy, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 17/737,584

(22) Filed: May 5, 2022

(65) Prior Publication Data

US 2023/0358456 A1 Nov. 9, 2023

(51) Int. Cl.
*F25B 49/02* (2006.01)

(52) U.S. Cl.
CPC ..... *F25B 49/022* (2013.01)

(58) Field of Classification Search
CPC ..... F25B 49/022
USPC ..... 62/115
See application file for complete search history.

(56) References Cited

U.S. PATENT DOCUMENTS

| | | | |
|---|---|---|---|
| 3,885,398 | A | 5/1975 | Dawkins |
| 10,589,593 | B2 | 3/2020 | Westendarp et al. |
| 10,668,783 | B2 | 6/2020 | Vehr et al. |
| 11,133,957 | B2 | 9/2021 | Portillo et al. |
| 2016/0215996 | A1 | 7/2016 | Blair et al. |
| 2017/0076601 | A1* | 3/2017 | Harter ..... G08G 1/207 |
| 2017/0203632 | A1* | 7/2017 | Westendarp ..... B60H 1/00521 |
| 2019/0092131 | A1* | 3/2019 | Vehr ..... F25B 5/02 |
| 2020/0148028 | A1 | 5/2020 | Westendarp et al. |
| 2021/0399917 | A1 | 12/2021 | Portillo et al. |
| 2022/0124157 | A1 | 4/2022 | Binder et al. |

FOREIGN PATENT DOCUMENTS

| | | | |
|---|---|---|---|
| CN | 109564047 | B | 12/2020 |
| CN | 109564045 | B | 8/2021 |
| CN | 113841331 | A | 12/2021 |

OTHER PUBLICATIONS

International Search Report and Written Opinion for international application No. PCT/US2023/020792 dated Aug. 17, 2023.

* cited by examiner

*Primary Examiner* — Nael N Babaa
(74) *Attorney, Agent, or Firm* — Harness, Dickey & Pierce, P.L.C.

(57) ABSTRACT

A system includes: a refrigerant compressor including an electric motor; a single printed circuit board (PCB); a drive that is disposed on the single PCB and that includes switches that control the application of power from a battery to the electric motor; and one or more processors disposed on the single PCB, the one or more processors configured to: determine a speed command for the refrigerant compressor based on one or more operating parameters; and actuate the switches of the drive based on the speed command.

14 Claims, 7 Drawing Sheets

HEATING AND COOLING SYSTEMS

FIELD

The present disclosure relates to vehicles and, more particularly, to air conditioning and refrigeration systems, such as those of vehicles, containers, and other types of refrigerated spaces.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Compressors may be used in a wide variety of industrial, commercial, and residential applications to circulate refrigerant to provide a desired heating or cooling effect. For example, a compressor may be used to provide heating and/or cooling in a refrigeration system, a heat pump system, a heating, ventilation, and air conditioning (HVAC/R) system, or a chiller system. These types of systems can be fixed, such as at a building or residence, or can be mobile, such as in, or as part of a vehicle. Vehicles include land based vehicles (e.g., trucks, cars, trains, etc.), water based vehicles (e.g., boats, sea containers), air based vehicles (e.g., airplanes), and vehicles that operate over a combination of more than one of land, water, and air.

A vehicle typically includes an HVAC/R system that heats and cools a driving area of the vehicle where a driver sits. Some vehicles, such as semi-trucks, also include a living area where a driver can sit, sleep, rest, etc. Some vehicles may include a partition (e.g., curtain or wall) that can be opened to join the driving area and the living area. The partition can also be closed to separate the driving and living areas, for example, for sleeping. Vehicles or containers for refrigeration typically include a dedicated compartment where product is stored and maintained at a specific controlled temperature.

Compressors of HVAC/R systems of vehicles and containers that may be engine driven, towed or hauled with an independent engine that provides/generates electricity to power the compressor. Thus, the engine is on to provide cooling. As such, in addition to running during movement of the vehicle or stationary applications, the engine of the vehicle or system stays running to provide cooling while the driver is sleeping and at other times when the vehicle is not moving when used in HVAC applications and to maintain a specific controlled temperature for products in refrigeration applications.

SUMMARY

In a feature, a system includes: a refrigerant compressor including an electric motor; a single printed circuit board (PCB); a drive that is disposed on the single PCB and that includes switches that control the application of power from a battery to the electric motor; and one or more processors disposed on the single PCB, the one or more processors configured to: determine a speed command for the refrigerant compressor based on one or more operating parameters; and actuate the switches of the drive based on the speed command.

In further features, an interface is disposed on the single PCB and configured to receive the power from the battery.

In further features, the interface is configured to be connected to a network bus.

In further features, the one or more processors are further configured to communicate via the network bus using the Society of Automotive Engineers (SAE) J1939 communication standard.

In further features, the one or more processors are configured to receive the one or more operating parameters via the network bus.

In further features, the one or more operating parameters include at least one of (a) a temperature of the system measured by a temperature sensor and (b) a pressure of the system measured by a pressure sensor.

In further features, the one or more processors are further configured to actuate an actuator of the system via the network bus.

In further features, a control module is not disposed on the single PCB, is configured to communicate via the network bus, and is configured to actuate the actuator in response to receipt of signals from the one or more processors via the network bus.

In further features, the actuator is one of a solenoid, a switch, a damper, a blower, an electronic expansion valve, and a fan.

In further features, one or more processors and the drive do not communicate using the MODBUS communication protocol.

In further features, the system is configured to cool a passenger cabin of a vehicle.

In further features: a second single PCB is separate from the single PCB; a second interface is disposed on the second single PCB; and a control module is disposed on the single PCB, the control module configured to: receive input from one or more input devices via the second interface; control one or more output devices via the second interface; and connect to a network bus via the second interface.

In further features, the control module and the one or more processors are configured to communicate via the network bus.

In further features, the control module and the one or more processors are configured to communicate via the network bus using the Society of Automotive Engineers (SAE) J1939 communication standard.

In a feature, a single printed circuit board includes: a drive that is disposed on the single PCB and that includes switches configured to control the application of power from a battery to an electric motor of a refrigerant compressor of a cooling system; one or more processors disposed on the single PCB, the one or more processors configured to: determine a speed command for the refrigerant compressor based on one or more operating parameters; and actuate the switches of the drive based on the speed command.

In a feature, a method includes: by one or more processors disposed on a single printed circuit board (PCB), determining a speed command for a refrigerant compressor based on one or more operating parameters; and by the one or more processors, actuating switches of a drive based on the speed command, where the drive is disposed on the single PCB and includes the switches, wherein the switches are configured to control the application of power from a battery to an electric motor of the refrigerant compressor of a cooling system.

In further features, the method further includes, by an interface disposed on the single PCB, receiving the power from the battery.

In further features, the method further includes, by the one or more processors, communicating via a network bus via the interface.

In further features, the communicating includes, by the one or more processors, communicating via the network bus using the Society of Automotive Engineers (SAE) J1939 communication standard.

In further features, the method further includes, by the one or more processors, receiving the one or more operating parameters via the network bus.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Some vehicles, such as semi trucks, have a passenger cabin that has two sections: a first section where a driver drives the vehicle; and a second section that the driver can, for example, sleep. Some vehicles include heating, ventilation, and air conditioning (HVAC) systems that have ducts that allow heating and cooling of both of the first and second sections.

A vehicle including an HVAC system may include an electric refrigerant compressor (for cooling) that is not driven by an engine. An inverter drive applies power to the electric refrigerant compressor from a battery pack based on a (e.g., variable) compressor speed command. A control module selectively varies the compressor speed command, for example, based on cooling demands in different locations and/or for different components (e.g., the battery pack).

A dedicated, separately implemented, and expensive control module can be used with a separately implemented drive. As an example, a PLC or a parametric controller could be used with a drive.

The present application involves integrating the inverter drive with the control module on a single printed circuit board (PCB). More specifically, the functionality of a separately implemented drive is performed by one or more processor(s) of the drive. This reduces cost and complexity and increases efficiency (e.g., power consumption) of the HVAC system.

While the example of an HVAC system is provided, the present application is also applicable to refrigeration systems, freezer systems, and other types of cooling systems that cool one or more enclosed spaces, such as a passenger cabin of a vehicle, a storage space of a vehicle (e.g., a refrigeration and/or freezer box of a vehicle), the interior of a container, etc. Also, while the example of a cooling system is provided, the present application is also applicable to use of compressors for heating, such as in heat pump systems including a reversing valve that can be actuated such that the compressor is used to provide heating under some circumstances and cooling under other circumstances.

Figure 1A:
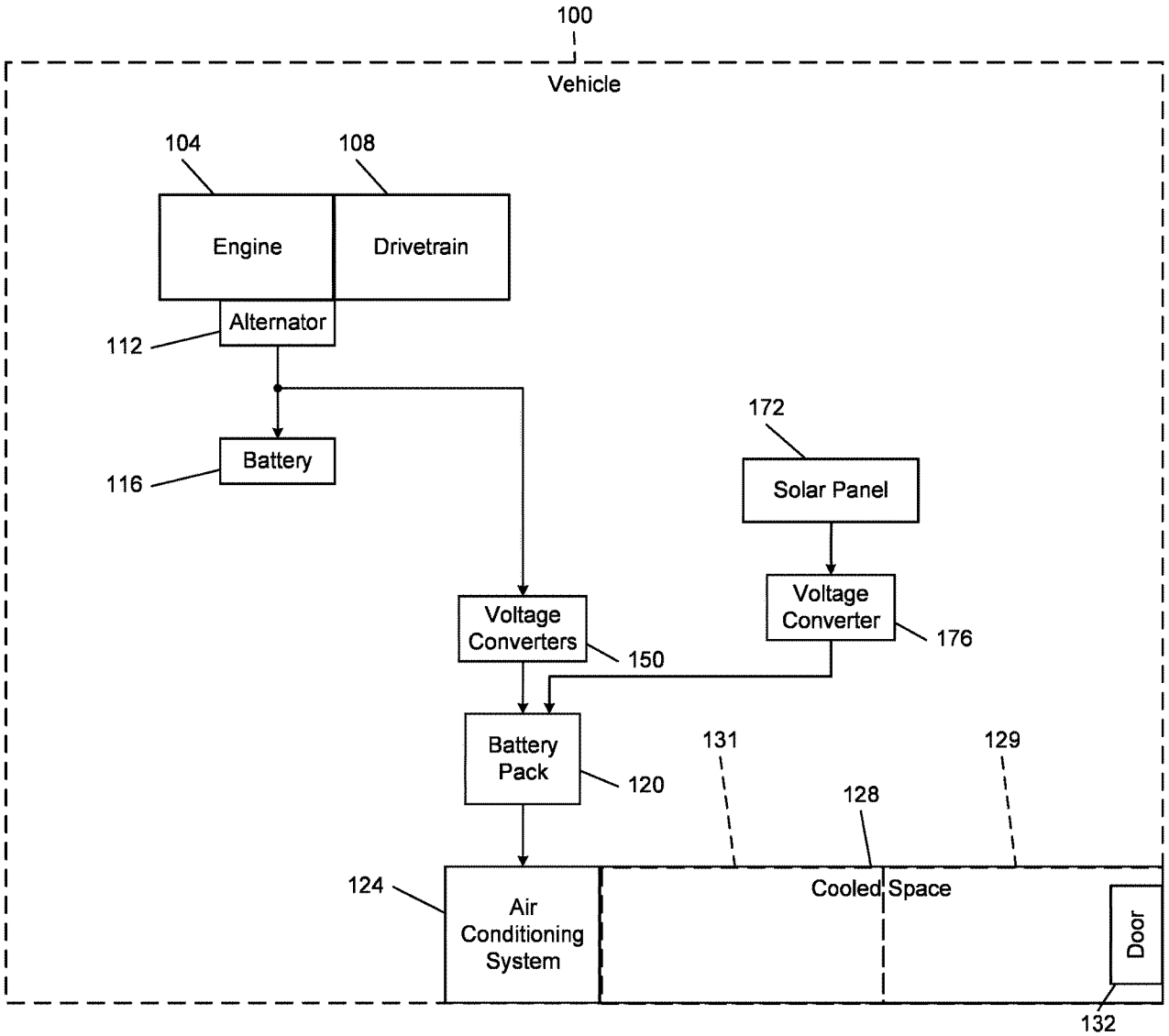
FIGS. 1A and 1B are functional block diagrams of example vehicle systems.
Figure 1B:
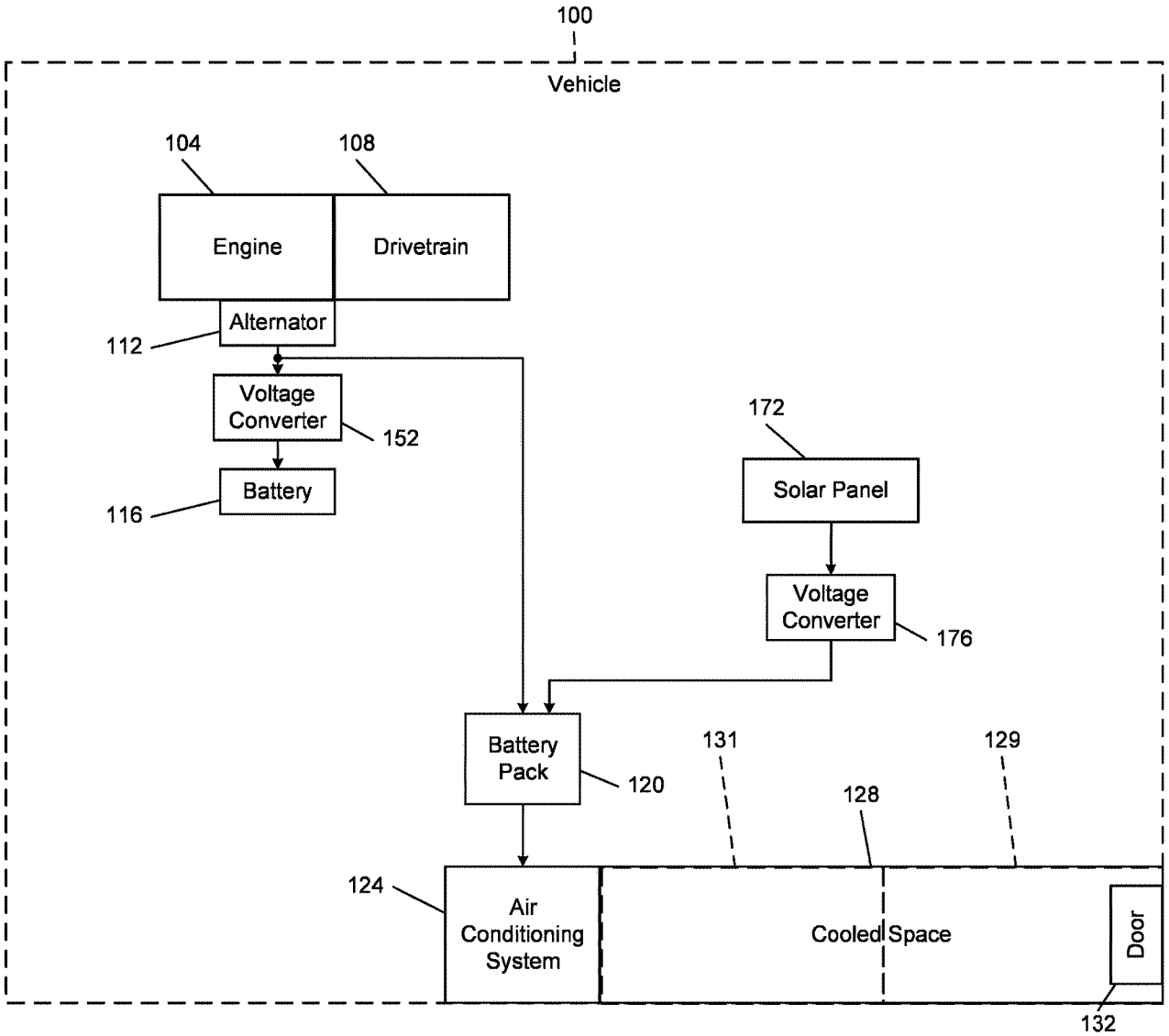

FIGS. 1A and 1B are functional block diagrams of example systems of a vehicle 100. The vehicle 100 includes an internal combustion engine 104 that combusts air and fuel within cylinders to generate propulsion torque for the vehicle 100. The engine 104 may combust, for example, gasoline, diesel fuel, natural gas, and/or one or more other types of fuel. The engine 104 outputs torque to a drivetrain 108. The drivetrain 108 transfers torque to two or more wheels of the vehicle. While the example of a semi truck is provided, the present application is also applicable to other types of land based vehicles (e.g., trucks, cars, trains, busses, recreational vehicles (RVs), motor homes, etc.), water based vehicles (e.g., boats), air based vehicles (e.g., airplanes), and vehicles that operate over a combination of more than one of land, water, and air. Also, while the example of a wheeled vehicle is provided, the present application is not limited to vehicles having wheels.

An electrical source 112 is driven by the engine 104 and converts mechanical energy of the engine 104 into electrical energy to charge a battery 116. The electrical source 112 may include an alternator, a generator, and/or another type of device that converts mechanical energy of the engine 104 into electrical energy. While the example of a single electrical source is provided, multiple or zero electrical sources driven by the engine 104 may be included. The electrical source 112 may be, for example, a 12 Volt (V) alternator (e.g., in the example of FIG. 1A) and/or a 48 V alternator (e.g., in the example of FIG. 1B). Also, while the example of the inclusion of the engine 104 is provided, the present application is also applicable to pure electric vehicles that do not include engines.

The vehicle 100 also includes a battery pack 120. For example only, the battery pack 120 may be a 48 V direct current (DC) battery pack, although another suitable battery pack may be used. The battery pack 120 may include two or more individual batteries connected together or may include one battery. For example, in the case of a 48 V battery pack, the battery pack 120 may include four 12 V batteries connected in series. The batteries may be connected such that a lower voltage, such as 12 V, 24 V, and/or 36 V can also be obtained from one, two, or three of the batteries. In the example of an electric vehicle, the vehicle 100 also includes one or more additional batteries (or battery packs) for propulsion.

In various implementations, the battery pack 120 may include four individual 12 V batteries connected in series. The batteries may be arranged in two banks (A and B), each bank having two individual 12 V batteries (batteries 1 and 2) connected in series, to provide two 24 V reference potentials.

The battery pack 120 supplies power to an HVAC system including an air conditioning system 124. The air conditioning system 124 selectively cools a cooled space 128. The cooled space 128 is a space within the vehicle 100 that can be cooled based on a setpoint temperature. A driver of the vehicle drives the vehicle while located (e.g., seated at a driver's seat) within the cooled space 128. In various implementations, the cooled space 128 may be divided (e.g., physically) into multiple cooled spaces that may be cooled based on respective setpoint temperatures. For example, a driving portion 129 of the cooled space 128 may be cooled based on a first setpoint temperature and a living portion 131 of the cooled space 128 may be cooled based on a second setpoint temperature. The living portion 131 may be behind the driving portion 129 relative to a forward direction of travel of the vehicle. The first setpoint temperature and the second setpoint temperature may be set according to user input (e.g., initiated by the driver or another user) for the first setpoint temperature and the second setpoint temperature, respectively.

A user may vary the first setpoint temperature via one or more user input devices, such as one or more user input devices located within the driving portion 129 of the cooled space 128. A user may vary the second setpoint temperature via one or more user input devices, such as one or more user input devices located within the living portion 131 of the cooled space 128. The vehicle 100 may be for example, but not limited to, a semi-truck that can be used to haul trailers (e.g., tractor trailers). The present application is more generally applicable to vehicles having two evaporator heat exchangers. As discussed further below, a control module may control the air conditioning system 124 based on temperature(s) within the cooled space(s), set point temperature(s), and other parameters.

The vehicle 100 may include one or more doors, such as door 132, that provide access to the cooled space 128 (e.g., the driving portion 129), for example, for entry into the vehicle and exit from the vehicle. While the example of only one door is shown, the vehicle 100 may include more than one door.

As shown in the examples of FIG. 1A, the vehicle 100 may include one or more voltage converters 150 that convert the output of the electrical source 112 into one or more outputs for charging the battery pack 120. In the example of the electrical source 112 generating a 12 V DC output, the one or more voltage converters 150 may boost (i.e., increase) the output of the electrical source 112, for example, to one or more other voltages (e.g., 24 V DC, 48 V DC) and charge the battery pack 120 via the boosted output. Since the electrical source 112 is driven by rotation of the engine 104, the electrical source 112 may be used to charge the battery pack 120 when the engine 104 is running. In the example of an electric vehicle, the electrical source 112 may be an electric machine (e.g., electric motor) functioning as an electrical generator.

In the example of the electrical source 112 generating a 48 V DC output, as shown in FIG. 1B, the output of the electrical source 112 may charge the battery pack 120. The vehicle 100, however, may include a voltage converter 152 that converts the output of the electrical source 112 into an output for charging the battery 116. For example, the voltage converter 152 may buck (i.e., decrease) the output of the electrical source 112, for example, to a lower voltage (e.g., 12 V DC) and charge the battery pack 120 via the bucked output. In various implementations, the vehicle 100 may also include a battery charger that selectively charges the battery 116 using received power (e.g., from the electrical source 112 or a voltage converter).

The vehicle 100 may also include one or more battery chargers that selectively charge the battery pack 120 using received power (e.g., from the electrical source 112 or a voltage converter). For example, the vehicle 100 may include four model SEC-2440 battery charger, manufactured by Samlex America Inc., of Burnaby, BC, Canada. The battery charger may be arranged, for example, in two groups of two 24 V, 40 A battery chargers connected to provide a 48 V, 80 A output for battery charging. While the example of battery chargers having a 24 V, 40 A output is provided, battery chargers having another output may be used, such as one 12 V charger connected to each battery. The battery chargers may also monitor the individual batteries of the battery pack 120 and control application of power to the respective batteries to prevent overcharging. In various implementations, a drive (discussed further below) may charge the battery pack 120 and separate battery chargers may be omitted.

While the electrical source 112 is shown as providing power for charging both the battery 116 and the battery pack 120, a second electrical source may be used to convert power of the engine 104 into electrical power for charging the battery pack 120. In this case, the electrical source 112 may be used to charge the battery 116, and the second electrical source may be used to charge the battery pack 120.

In various implementations, the battery pack 120 may be charged via one or more other power sources. For example, the battery pack 120 may be charged using power from a utility received via a receptacle of the vehicle. The receptacle may be configured to receive AC or DC power. For example, the receptacle may receive AC power from a utility via a power cord (e.g., an extension cord) connected between the receptacle and a wall outlet or charger of a building. The receptacle may be, for example, a single phase 110/120 or 208/240 V AC receptacle or a 3-phase 208/240 V AC receptacle. In various implementations, the vehicle 100 may include both a 110/120 V AC receptacle and a 208/240 V AC receptacle. While the example of the receptacle receiving AC power is provided, the receptacle may alternatively receive DC power from via a power cord. Power received from a utility via a receptacle will be referred to as shore power. In this example, the vehicle 100 may include one or more battery chargers that charge the battery pack 120 using shore power. These one or more battery chargers may be the same or different than those referenced above.

The vehicle 100 may optionally include a solar panel 172. The solar panel 172 converts solar energy into electrical energy. While the example of one solar panel is provided, multiple or zero solar panels may be included. A voltage converter 176 converts power output by the solar panel 172 and charges the battery pack 120.

As discussed further below, the air conditioning system 124 includes an electric variable speed compressor that is not mechanically driven by any rotating component of the vehicle 100, such as the engine 104 or a component of the drivetrain 108. The variable speed compressor is instead driven via electrical power applied to an electric motor of the variable speed compressor. A control module controls operation of the variable speed compressor to maximize comfort within the cooled space 128, maximize efficiency of the air conditioning system 124, minimize discharging of the battery pack 120, and maximize life of components of the air conditioning system 124.

Figure 2:
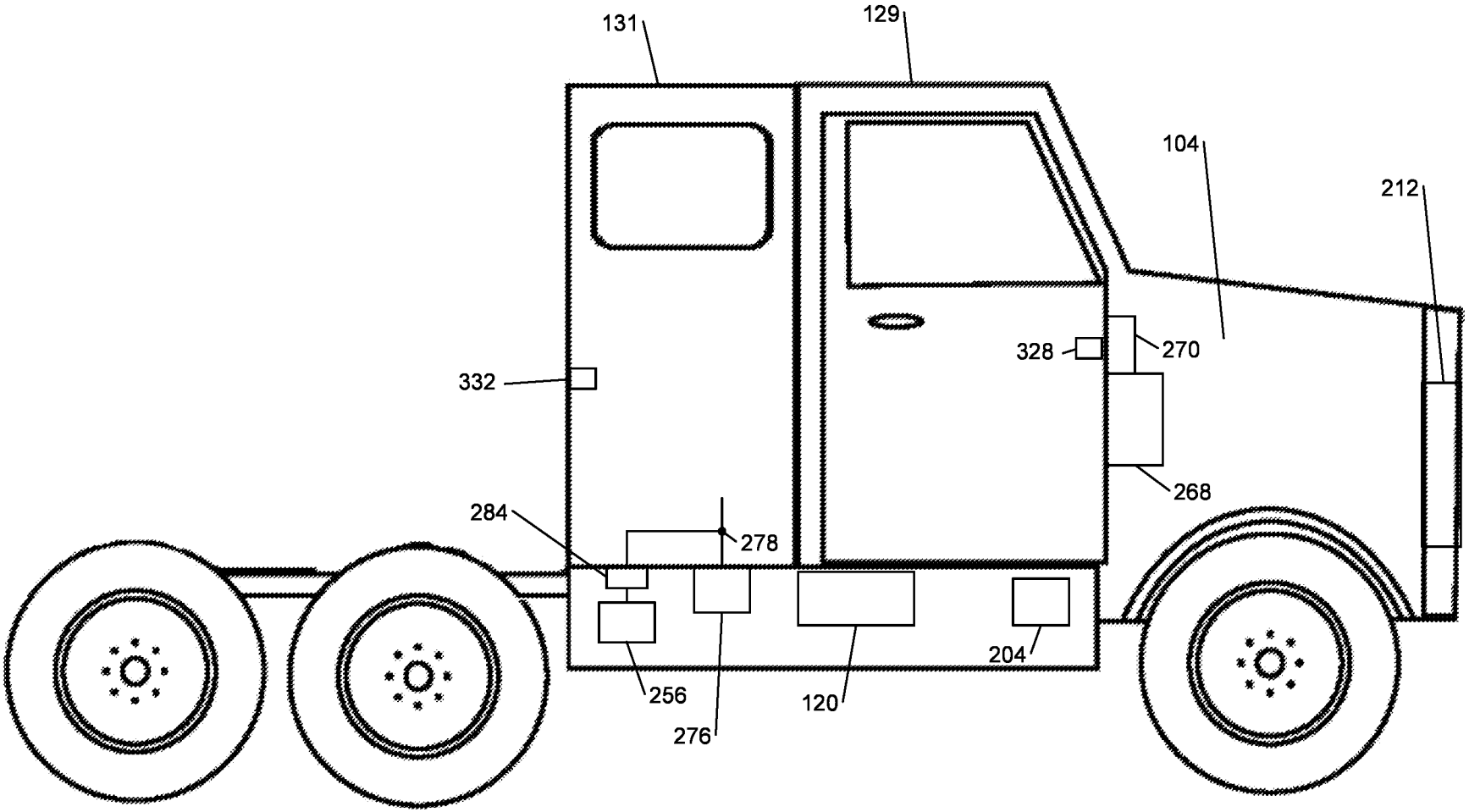
FIG. 2 includes an example illustration of an example vehicle including components of an air conditioning system.
Figure 3:
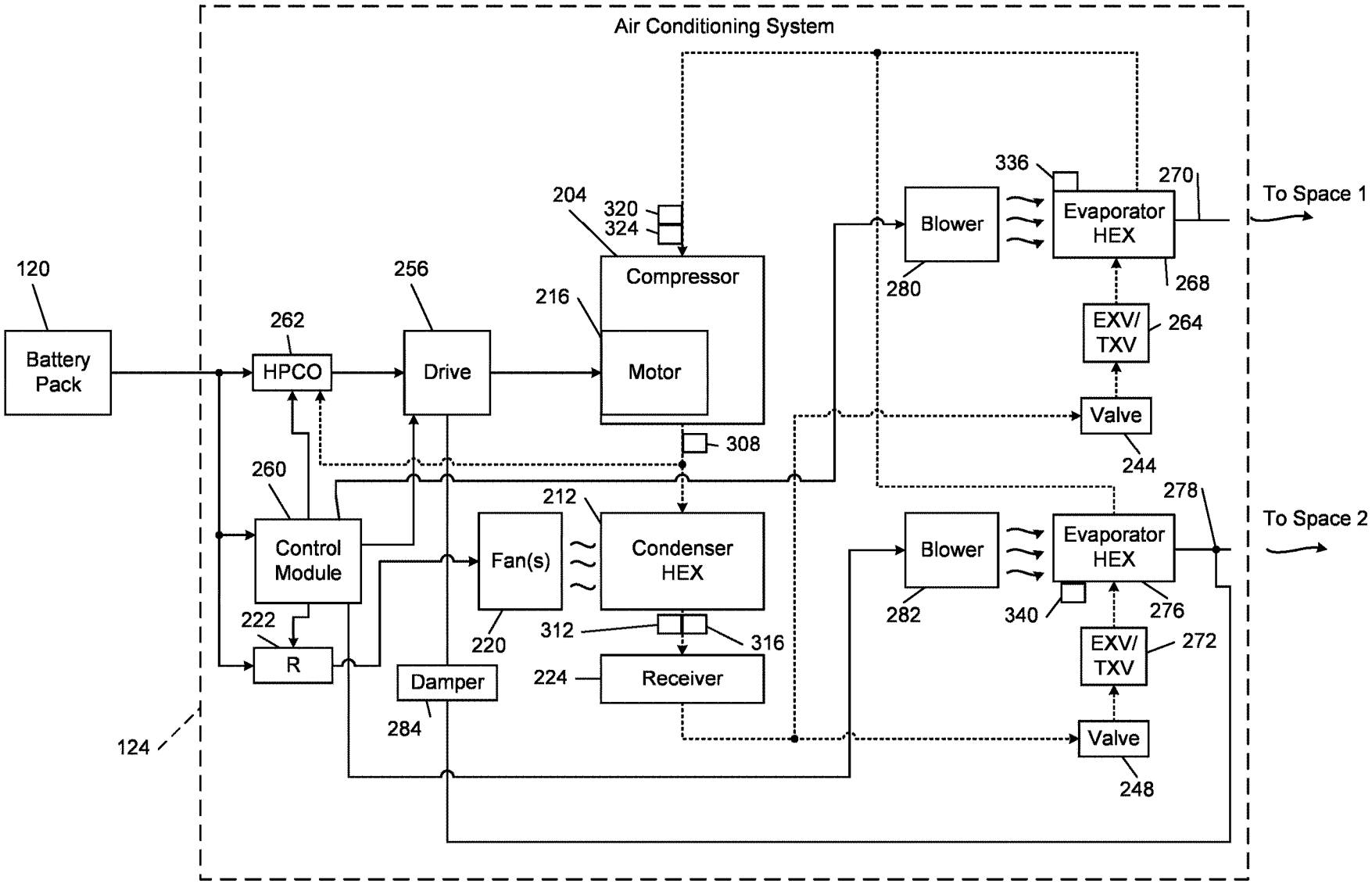
FIG. 3 includes a functional block diagram of an example implementation of the air conditioning system.

FIG. 2 includes an example illustration of an example truck including components of the air conditioning system 124. FIG. 3 includes a functional block diagram of an example implementation of the air conditioning system 124. In the example of FIG. 3, dotted lines indicate refrigerant flow, and solid lines indicate electrical connections and physical connections.

Referring now to FIGS. 2 and 3, a compressor 204 receives refrigerant vapor via a suction line of the compressor 204. In various implementations, the compressor 204 may receive refrigerant vapor from an accumulator that collects liquid refrigerant to minimize liquid refrigerant flow to the compressor 204.

The compressor 204 compresses the refrigerant and provides pressurized refrigerant in vapor form to a condenser heat exchanger (HEX) 212. The compressor 204 includes an electric motor 216 that drives a pump to compress the refrigerant. For example only, the compressor 204 may include a scroll compressor, a reciprocating compressor, or another type of refrigerant compressor. The electric motor 216 may include, for example, an induction motor, a permanent magnet motor (brushed or brushless), or another suitable type of electric motor. In various implementations, the electric motor 216 may be a brushless permanent magnet (BPM) motor. BPM motors may be more efficient than other types of electric motors. The compressor 204 is a variable speed compressor.

All or a portion of the pressurized refrigerant is converted into liquid form within the condenser HEX 212. The condenser HEX 212 transfers heat away from the refrigerant, thereby cooling the refrigerant. When the refrigerant vapor is cooled to a temperature that is less than a saturation temperature of the refrigerant, the refrigerant transitions into liquid (or liquefied) form.

One or more condenser fans 220 may be implemented to increase airflow over, around, and/or through the condenser HEX 212 and increase the rate of heat transfer away from the refrigerant. As shown in FIG. 2, the condenser HEX 212 may be implemented near a front of the vehicle 100 such that air flows through the condenser HEX 212 when the vehicle 100 is traveling in the forward direction. The condenser HEX 212, however, may be located in another suitable location.

Refrigerant from the condenser HEX 212 may be delivered to a receiver 224. The receiver 224 may be implemented to store excess refrigerant. In various implementations, the receiver 224 may be omitted. A filter drier may be implemented to remove moisture and debris from the refrigerant. In various implementations, the filter drier may be omitted.

In various implementations, the air conditioning system 124 may include an enhanced vapor injection (EVI) system. The EVI system may expand a portion of the refrigerant from the receiver 224 to vapor form, superheat the vapor refrigerant, and provide the superheated vapor refrigerant to the compressor 204, such as at a midpoint within a compression chamber of the compressor 204. EVI may be performed, for example, to increase capacity and increase efficiency of the air conditioning system 124.

Refrigerant from the receiver 224 flows to a first evaporator control valve 244 and a second evaporator control valve 248. The first evaporator control valve 244 may be, for example, a solenoid valve or another suitable type of valve. The second evaporator control valve 248 may be, for example, a solenoid valve or another suitable type of valve.

Before flowing to the first evaporator control valve 244 and the second evaporator control valve 248, the refrigerant may flow through a drive HEX. The drive HEX draws heat away from a drive 256 (e.g., an inverter drive) and transfers heat to refrigerant flowing through the drive HEX. While the example of the drive 256 being liquid (refrigerant) cooled is provided, liquid cooling may be omitted, and the drive 256 may be air cooled. Air cooling may be active (e.g., via one or more devices) and/or passive (e.g., by conduction and convection). An example of active cooling of the drive 256 is discussed further below.

The drive 256 controls application of power to the electric motor 216 from the battery pack 120. For example, the drive 256 may control application of power to the electric motor 216 based on a compressor speed command from a control module 260. Based on the compressor speed command, the drive 256 may generate three-phase AC power (e.g., 208/240 VAC) from the power output of the battery pack 120 and apply the three-phase AC power to the electric motor 216. The drive 256 may set one or more characteristics of the three-phase AC power based on the compressor speed command, such as frequency, voltage, and/or current. For example only, the drive 256 may be a variable frequency drive (VFD). The drive 256 may, for example, determine a pulse width modulation (PWM) duty cycle to apply to switches of the drive 256 to generate AC power having the characteristics. In various implementations, one or more electromagnetic interference (EMI) filters may be implemented between the battery pack 120 and the drive 256.

The control module 260 may set the compressor speed command to a plurality of different possible speeds for variable speed operation of the electric motor 216 and the compressor 204 based on one or more operating parameters. The control module 260 and the drive 256 are integrated on a single PCB as discussed further below.

A high pressure cut off (HPCO) 262 may be implemented to disconnect the drive 256 from power and disable the electric motor 216 when a pressure of refrigerant output by the compressor 204 becomes greater than a predetermined pressure. The control module 260 may also control operation of the compressor 204 based on a comparison of the pressure of refrigerant output by the compressor 204. For example, the control module 260 may shut down or reduce the speed of the compressor 204 when the pressure of refrigerant output by the compressor 204 is less than a second predetermined pressure that is less than or equal to the predetermined pressure used by the HPCO 262.

When the first evaporator control valve 244 is open, refrigerant may be expanded to vapor form by a first expansion valve 264 and provided to a first evaporator HEX 268. The first expansion valve 264 may include a TXV (thermal expansion valve) or may be an EXV (electronic expansion valve).

The first evaporator HEX 268 provides cooled air to the driving portion 129 of the cooled space 128. More specifically, the vapor refrigerant within the first evaporator HEX 268 transfers heat away (i.e., absorbs heat) from air passing through the first evaporator HEX 268. The cooled air flows from the first evaporator HEX 268 to the driving portion 129 of the vehicle 100 via first HVAC ducts 270. The first HVAC ducts 270 include at least one duct through which cooled air flows to a passenger side of the vehicle 100 and at least one duct through which cooled air flows to a driver side of the vehicle 100.

When the second evaporator control valve 248 is open, refrigerant may be expanded to vapor form by a second expansion valve 272 and provided to a second evaporator HEX 276. The second expansion valve 272 may include a TXV or may be an EXV. The second evaporator HEX 276 provides cooled air to the living portion 131 of the cooled space 128. More specifically, the vapor refrigerant within the second evaporator HEX 276 transfers heat away (i.e., absorbs heat) from air passing through the second evaporator HEX 276. The cooled air flows from the second evaporator HEX 276 to the living portion 131 of the vehicle 100 via second HVAC ducts 278. The second HVAC ducts 278 include at least one duct through which cooled air flows to a passenger side of the vehicle 100 and at least one duct through which cooled air flows to a driver side of the vehicle 100.

A first blower 280 draws air from the cooled space 128 and/or from outside of the vehicle 100. When on, the first blower 280 increases airflow over, around, and/or through the first evaporator HEX 268 to increase the rate of heat transfer away from (i.e., cooling of) the air flowing through the first evaporator HEX 268 and to the cooled space 128.

A second blower 282 draws air from the cooled space 128 and/or from outside of the vehicle 100. When on, the second blower 282 increases airflow over, around, and/or through the second evaporator HEX 276 to increase the rate of heat transfer away from (i.e., cooling of) the air flowing through the second evaporator HEX 276 and to the cooled space 128. Refrigerant from the first evaporator HEX 268 and the second evaporator HEX 276 flows back to the compressor 204 for a next cycle.

The control module 260 may control the speed of the first blower 280 and the speed of the second blower 282 as discussed further below. For example, the control module 260 may control application of power to electric motors of the first and second blowers 280 and 282 from the battery pack 120 based on respective speed commands. Based on the respective speed commands, the control module 260 may generate AC power (e.g., single-phase or three-phase) from the power output of the battery pack 120 and apply the AC power to the electric motor 216. The control module 260 may set one or more characteristics of the AC power based on the respective speed commands, such as frequency, voltage, and/or current. The control module 260 may, for example, determine PWM duty cycles to apply to switches of the drive 256 to generate AC powers having the characteristics.

The control module 260 may set the speed commands for the blowers to a plurality of different possible speeds for variable speed operation of the first and second blowers 280 and 282 based on one or more operating parameters. While the example of the control module 260 applying power to the first and second blowers 280 and 282 is provided, another module or the drive 256 may apply power to the first and second blowers 280 and 282.

Regarding active cooling of the drive 256, a damper door 284 may be implemented to allow or block airflow from the second blower 282 to a housing that houses the drive 256. For example, when the damper door 284 is open, cool air from the second evaporator HEX 276 or cool air from the second HVAC ducts 278 may travel to the cooled space 128 and into the housing of the drive 256 to cool the drive 256. When the damper door 284 is closed, the damper door 284 may block airflow to the housing (and therefore the drive 256). While the example of the damper door 284 is provided, another suitable actuator may be used to allow/prevent airflow to the drive 256. Curved lines in FIG. 3 are illustrative of air flow.

The air conditioning system 124 may also include a compressor pressure regulator (CPR) valve that regulates pressure of refrigerant input to the compressor 204 via the suction line. For example, the CPR valve may be closed to limit pressure into the compressor 204 during startup of the compressor 204. The CPR valve may be an electronically controlled valve (e.g., a stepper motor or solenoid valve), a mechanical valve, or another suitable type of valve. In various implementations, the CPR valve may be omitted.

Figure 4:
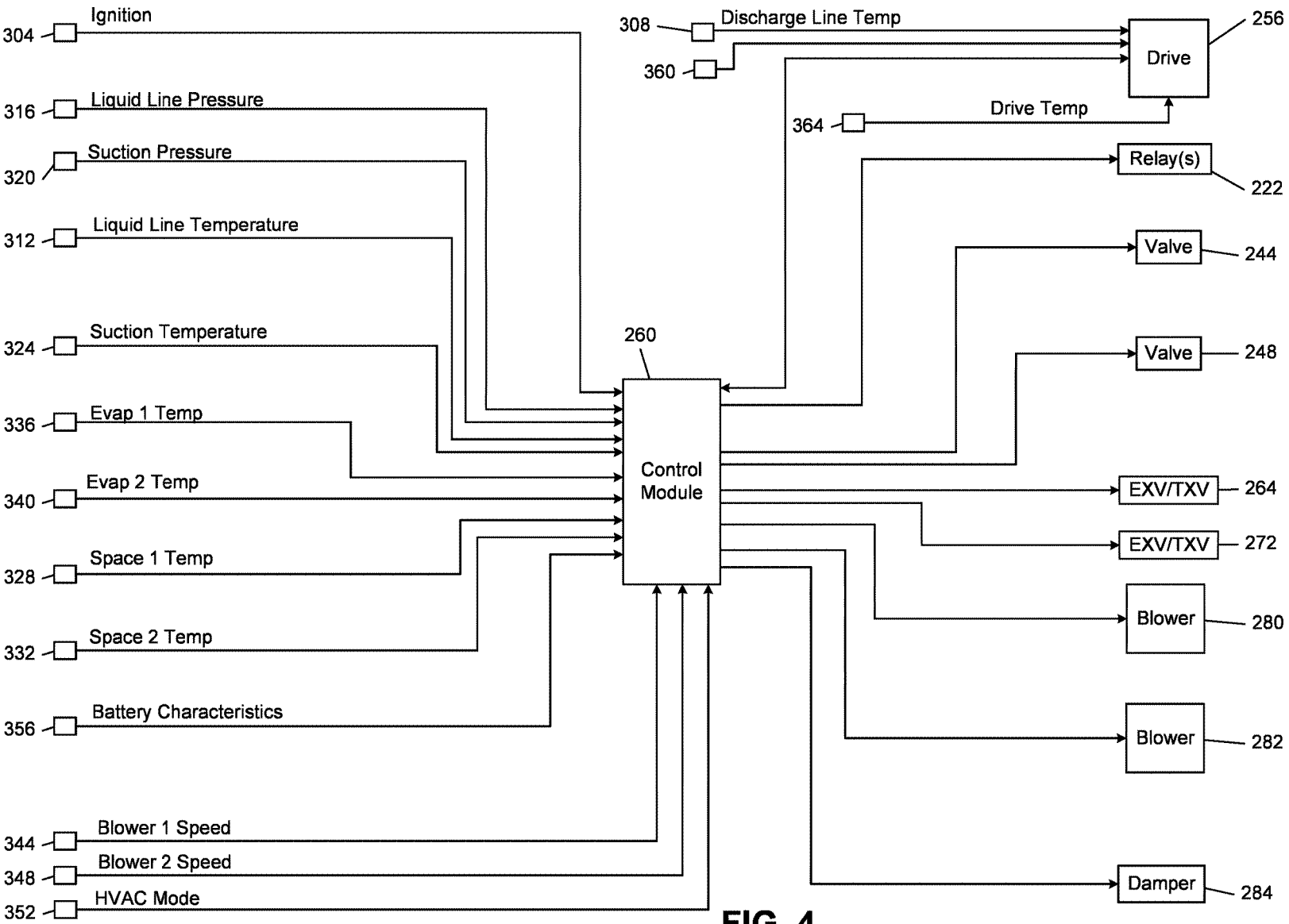
FIG. 4 includes a functional block diagram of an example system including a control module, various sensors of the vehicle, and various actuators of the vehicle.

FIG. 4 includes a functional block diagram of an example system including the control module 260, various sensors of the vehicle 100, and various actuators of the vehicle 100. The control module 260 receives various measured parameters and indications from sensors of the vehicle 100. The control module 260 controls actuators of the air conditioning system 124 of the vehicle 100.

An ignition sensor 304 indicates whether an ignition system of the vehicle 100 is ON or OFF. A driver may turn the ignition system of the vehicle 100 ON and start the engine 104, for example, by actuating an ignition key, button, or switch. The ignition system being ON indicates that the engine 104 is ON and combusting air and fuel. A driver may turn the ignition system of the vehicle 100 OFF and shut down the engine 104, for example, by actuating the ignition key, button, or switch. The ignition system of being OFF indicates that the engine 104 is OFF and not combusting and air fuel.

A discharge line temperature (DLT) sensor 308 measures a temperature of refrigerant output by the compressor 204 (e.g., in the discharge line). The temperature of refrigerant output by the compressor 204 can be referred to as discharge line temperature or DLT. The discharge line temperature may be directly provided to the control module 260. Alternatively, the discharge line temperature may be provided to the drive 256 and the drive 256 may communicate the discharge line temperature to the control module 260.

A liquid line temperature sensor 312 measures a temperature of liquid refrigerant output from the condenser HEX 212 (e.g., in the liquid line). The temperature of refrigerant output by the condenser HEX 212 can be referred to as liquid line temperature. While one example location of the liquid line temperature sensor 312 is shown in FIG. 3, the liquid line temperature sensor 312 may be located at another location where liquid refrigerant is present in the refrigerant path from the condenser HEX 212 to the second evaporator HEX 276 and the first evaporator HEX 268.

A liquid line pressure sensor 316 measures a pressure of liquid refrigerant output from the condenser HEX 212 (e.g., in the liquid line). The pressure of refrigerant output by the condenser HEX 212 can be referred to as liquid line pressure. While one example location of the liquid line pressure sensor 316 is shown in FIG. 3, the liquid line pressure sensor 316 may be located at another location where liquid refrigerant is present in the refrigerant path from the condenser HEX 212 to the second evaporator HEX 276 and the first evaporator HEX 268.

A suction pressure sensor 320 measures a pressure of refrigerant input to the compressor 204 (e.g., in the suction line). The pressure of refrigerant input to the compressor 204 can be referred to as suction pressure.

A suction temperature sensor 324 measures a temperature of refrigerant input to the compressor 204 (e.g., in the suction line). The temperature of refrigerant input to the compressor 204 can be referred to as suction temperature.

A first air temperature sensor 328 measures a temperature of air in the driving portion 129 of the cooled space 128. For example, the first air temperature sensor 328 may measure a temperature of air input to the first evaporator HEX 268. The temperature of air in the driving portion 129 may be referred to as a driving portion temperature or a first space temperature (Space 1 temp).

A second air temperature sensor 332 measures a temperature of air in the living portion 131 of the cooled space 128. For example, the second air temperature sensor 332 may measure a temperature of air input to the second evaporator HEX 276. The temperature of air in the living portion 131 may be referred to as a living portion temperature or a second space temperature (Space 2 temp).

A first evaporator temperature sensor 336 measures a temperature of the first evaporator HEX 268. For example, the first evaporator temperature sensor 336 may measure the temperature of the first evaporator HEX 268 at or near a midpoint of refrigerant flow through the first evaporator HEX 268. The temperature of the first evaporator HEX 268 can be referred to as a first evaporator temperature.

A second evaporator temperature sensor 340 measures a temperature of the second evaporator HEX 276. For example, the second evaporator temperature sensor 340 may measure the temperature of the second evaporator HEX 276 at or near a midpoint of refrigerant flow through the second evaporator HEX 276. The temperature of the second evaporator HEX 276 can be referred to as a second evaporator temperature.

A first blower speed input 344 adjusts a first blower speed command of the first blower 280 based on user interaction (e.g., actuation, touching, etc.) with one or user input devices. For example, the first blower speed input 344 may increment and decrement the first blower speed command for the first blower 280 based on user input with the one or more user input devices. A second blower speed input 348 adjusts a second blower speed command of the second blower 282 based on user interaction (e.g., actuation, touching, etc.) with one or more user input devices. For example, the second blower speed input 348 may increment and decrement the second blower speed command for the second blower 282 based on user input with the one or more user input devices. Examples of user input devices include one or more buttons, switches, and/or touchscreen displays.

A HVAC mode sensor 352 indicates a HVAC mode requested for the cooled space 128. The HVAC mode may be, for example, heat, NC, maximum A/C, or OFF. The HVAC mode sensor 352 may indicate the HVAC mode based on user interaction (e.g., actuation, touching, etc.) with one or more input devices, such as one or more buttons, switches, and/or a touchscreen display. In various implementations, the HVAC mode may be provided by another control module of the vehicle 100.

A battery sensor 356 measures characteristics of a battery of the battery pack 120, such as voltage, current flow, temperature, and/or state of charge. In various implementations, a voltage sensor, a current sensor, and/or a temperature sensor may be provided with each battery of the battery pack 120. The battery sensor 356 may determine a state of charge (SOC) of the battery pack 120 based on one or more of the measured parameters.

One or more power sensors 360 measure power parameters of the drive 256. For example, a voltage sensor may measure a voltage input to the drive 256. A current sensor may measure a current flow to the drive 256. A power sensor may measure a power consumption of the drive 256. In various implementations, current and power sensors may be omitted, and the drive 256 may determine one or more currents and/or power consumption. In various implementations, the drive 256 may communicate the power consumption to the control module 260. The drive 256 or another module may determine the power consumption of the drive 256 based on one or more measured parameters (e.g., voltage input to the drive 256*current flow to the drive 256) and/or one or more other parameters (e.g., current flow to the drive 256 and a resistance of the drive 256).

A drive temperature sensor 364 measures a temperature at a location on the drive 256. A temperature of the drive 256 may be referred to as a drive temperature. In various implementations, the drive temperature sensor 364 may be implemented in the drive 256, and the drive 256 may communicate the drive temperature to the control module 260. In implementations, multiple drive temperature sensors may measure temperatures at different locations on the drive 256. In the example of the multiple drive temperature sensors, a highest (largest/hottest) one of the measured temperatures may be used as the drive temperature.

Sensors described herein may be analog sensors or digital sensors. In the case of an analog sensor, the analog signal generated by the sensor may be sampled and digitized (e.g., by the control module 260, the drive 256, or another control module) to generate digital values, respectively, corresponding to the measurements of the sensor. In various implementations, the vehicle 100 may include a combination of analog sensors and digital sensors. For example, the ignition sensor 304 and the HVAC mode sensor 352 may be digital sensors. The liquid line pressure sensor 316, the suction pressure sensor 320, the liquid line temperature sensor 312, the suction temperature sensor 324, the first evaporator temperature sensor 336, the second evaporator temperature sensor 340, the first air temperature sensor 328, the second air temperature sensor 332, and the first and second blower speed inputs 344 and 348 may be analog sensors/devices.

As discussed further below, the control module 260 controls actuators of the air conditioning system 124 based on various measured parameters, indications, setpoints, and other parameters.

For example, the control module 260 may control a speed of the electric motor 216 of the compressor 204 via the drive 256. The control module 260 may also control the condenser fan(s) 220. For example, one or more relays (R) 222 may be connected between the battery pack 120 and the condenser fan(s). While the example of relays is provided, another suitable type of switching device may be used. The control module 260 may control switching of the relay(s) 222 to control the speed of the condenser fan(s) 220. For example, the control module 260 may control the speed of a condenser fan using pulse width modulation (PWM) or analog (e.g., 0-10 or 0-5 volts DC) control of a relay or an integrated fan control module. Increasing the on period of the PWM signal or the analog voltage applied to the integrated fan control module or relay increases the speed of the condenser fan. Conversely, decreasing the on period of the PWM signal or the analog voltage applied to the integrated fan control module or relay decreases the speed of the condenser fan.

One or more of the condenser fan(s) 220 may be variable speed and/or one or more of the condenser fan(s) 220 may be fixed speed. For example, the condenser fan(s) 220 may include one fixed speed fan and one variable speed fan. For a fixed speed condenser fan, when the fan is to be ON, the control module 260 closes the associated relay and maintains the relay closed. For a variable speed fan, the control module 260 may determine a speed command and apply a PWM signal or analog voltage to the associated relay or integrated fan control module based on the speed command. The control module 260 may determine the ON period of the PWM signal or the analog voltage to apply, for example, using one of a lookup table and an equation that relates speed commands to on periods of PWM signals or analog voltages.

The control module 260 may also control the first evaporator control valve 244. For example, the control module 260 may control the first evaporator control valve 244 to be open to enable refrigerant flow through the first evaporator HEX 268 or closed to disable refrigerant flow through the first evaporator HEX 268. In the example of the first expansion valve 264 being an EXV, the control module 260 may control opening of the first expansion valve 264.

The control module 260 may also control the second evaporator control valve 248. For example, the control module 260 may control the second evaporator control valve 248 to be open to enable refrigerant flow through the second evaporator HEX 276 or closed to disable refrigerant flow through the second evaporator HEX 276. In the example of the second expansion valve 272 being an EXV, the control module 260 may control opening of the second expansion valve 272.

The control module 260 may receive a signal that indicates whether the HPCO 262 has tripped (open circuited). The control module 260 may take one or more remedial actions when the HPCO 262 has tripped, such as closing one, more than one, or all of the above mentioned valves and/or turning OFF one, more than one, or all of the above mentioned fans. The control module 260 may generate an output signal indicating that the HPCO 262 has tripped when the discharge pressure of the compressor 204 is greater than a predetermined pressure. The control module 260 may enable operation of the air conditioning system 124 after the HPCO 262 closes in response to the discharge pressure falling below than the predetermined pressure. In various implementations, the control module 260 may also require that one or more operating conditions be satisfied before enabling operation of the air conditioning system 124 after the HPCO 262 closes.

The control module 260 may control the speeds of the first and second blowers 280 and 282. The first and second blowers 280 and 282 are variable speed blowers, and the control module 260 may determine first and second speed commands for the first and second blowers 280 and 282 and control the application of power to the first and second blowers 280 and 282 based on the first and second speed commands, respectively.

Figure 5:
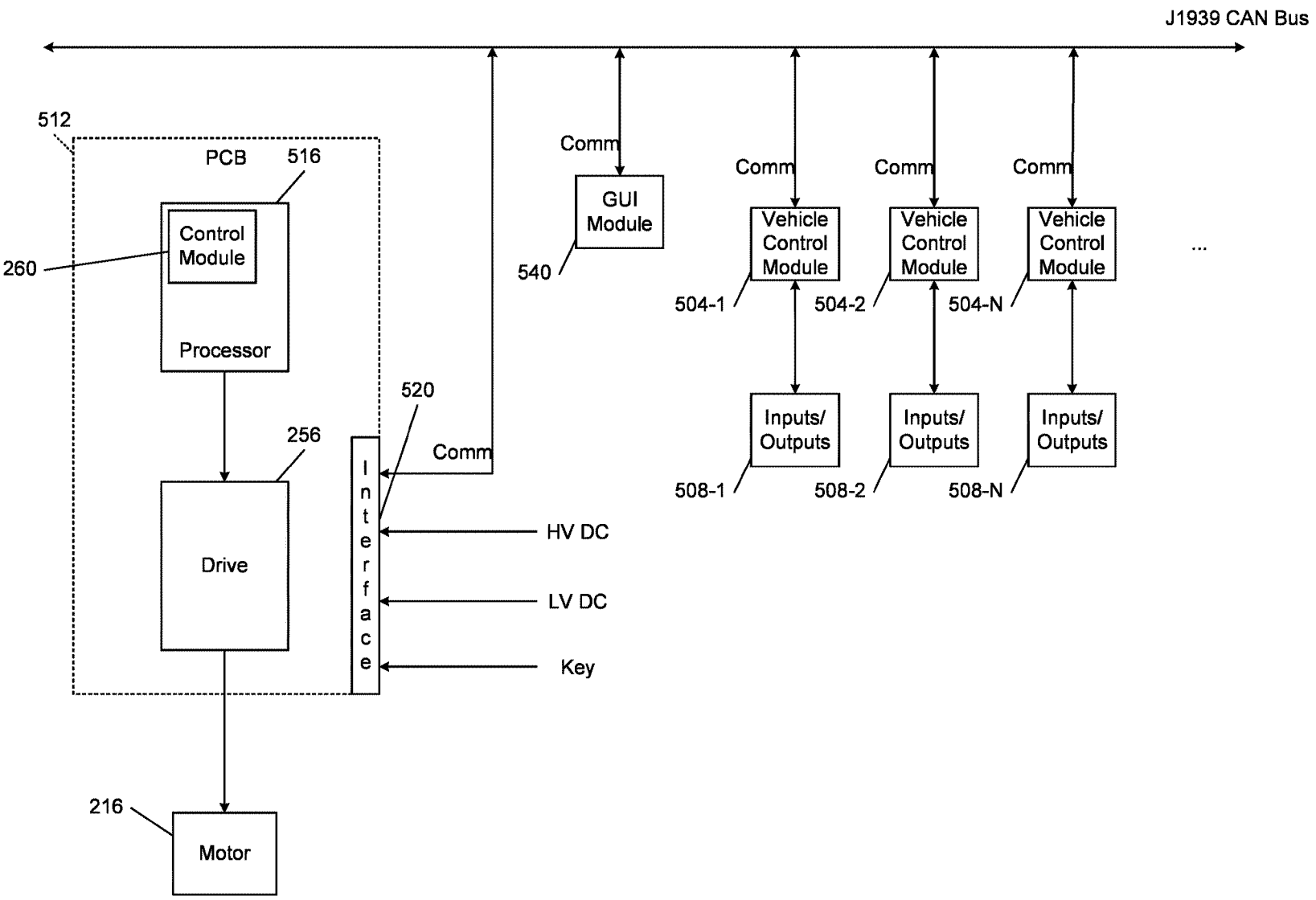
FIG. 5 includes a functional block diagram of an example implementation of a vehicle control system.

FIG. 5 is a functional block diagram of an example vehicle control system. The vehicle includes multiple vehicle control modules 504-1, 504-2, . . . , 504-N (collectively vehicle control modules 504). The vehicle control modules 504 have respective inputs and outputs 508-1, 508-2, . . . , 508-N (collectively inputs and outputs 508). Examples of the inputs (devices) include sensors (e.g., pressure, temperature, voltage, current, power, etc.), input devices (e.g., knobs, switches, etc.) and other types of devices configured to input signals. Examples of the outputs (devices) include contactors, solenoids, dampers, fans, displays, indicators (e.g., lights), actuators, and other types of devices configured to receive output signals. The vehicle control modules 508 communicate via a network bus, such as a vehicle area network bus or a car area network (CAN) bus using a communication protocol, such as the Society of Automotive Engineers J1939 communication protocol or another suitable communication protocol.

The drive 256 and the control module 260 are implemented together on a single printed circuit board (PCB) 512. The functionality of the control module 260 may be executed by one or more processors 516 on the PCB 512. As an example, the processor 516 may include an STM32F processor by ARM or another suitable type of processor. The drive 256 includes switches that control the application of power to the motor 216. The drive 256 and the control module 260 communicate directly and not using a Modbus communication protocol.

An input/output interface 520 having a plurality of input and output pins (e.g., 35 I/O pins) is disposed on the PCB 512. The processor 516, the drive 256, or both are connected to the interface 520 to receive input from the network bus (from other vehicle control modules) and/or to output data to the network bus (e.g., for other vehicle control modules). In this manner, the control module 260 and the drive 256 behave as another node (like the vehicle control modules 504) on the network bus.

Examples of inputs to the interface 520 include high voltage (HV) DC power, such as from a battery pack, low voltage (LV) DC power from a battery pack, and the output (Key) from the ignition sensor 304 that indicates whether the ignition system of the vehicle 100 is ON or OFF. Other inputs may also be connected to the interface 520. The interface 520 may be a male type interface or a female type interface. A portion of the processor 516 of the drive 256 can be used to achieve the functionality of the control module 260 without the need for a separate control module. The processor 516 controls switching of the switches of the drive 256, such as signals applied to gates of the switches of the drive 256. If the control module 260 was implemented separately, the control module 260 would communicate the speed command to the processor 516 (e.g., via Modbus communication), and the processor 516 would control switching based on the speed command. As implemented, the processor 516 determines the speed command (via the functionality of the control module 260) and controls switching of the switches of the drive 256.

The inclusion of the control module 260 and the drive 256 on the single PCB 512 makes implementation easier and less costly than if the control module 260 was implemented separately on a separate PCB. Unification with the other vehicle control modules 504 is also achieved. Also, separately implemented control modules may cause the HVAC system to be less efficiently than the control module 260 being executed by the processor 516. Response time to control the motor 216 also decreases (improves) relative to a separately implemented control module. The inputs described above (e.g., FIG. 4) can be received via the network bus from other vehicle control modules 504. Also, the control module 260 can control of the other devices of the HVAC system (e.g., FIG. 4) via the other vehicle control modules 504. In various implementations, a graphical user interface (GUI) module 540 may be included and communicate via the network bus. The GUI module 540 may include a display, such as a touch screen display, that can be used to display one or more parameters. Input may also be received via the touchscreen display and one or more other types of user input devices. Control of one or more functions may be adjusted based on one or more of the user inputs.

Figure 6:
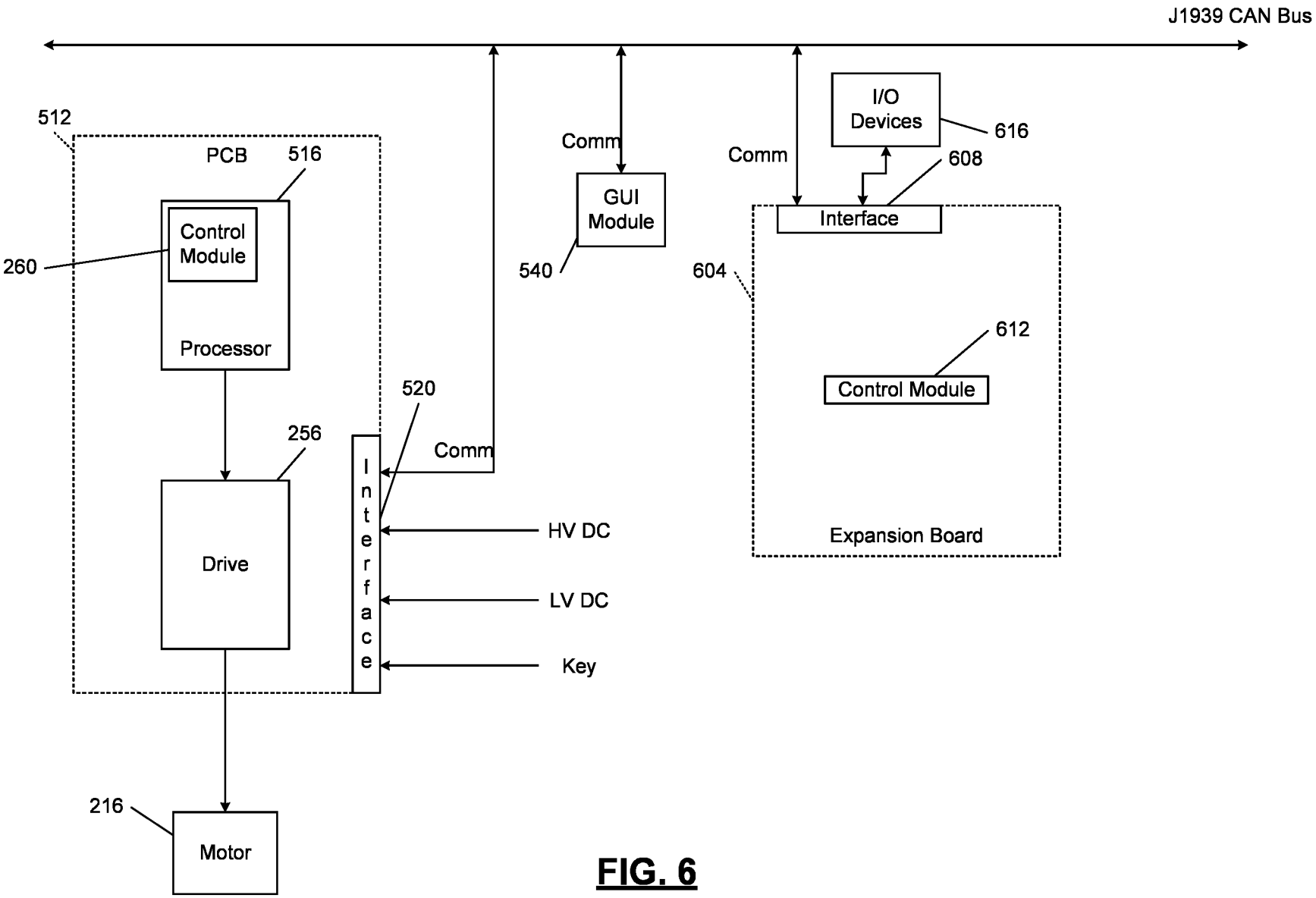
FIG. 6 is a functional block diagram of an example implementation of a control system.

FIG. 6 is a functional block diagram of an example control system. In various implementations, an expansion (circuit) board 604 may be connected to the network bus. An input/output interface 608 having a plurality of input and output pins (e.g., 35 I/O pins) is disposed on the PCB 512. The expansion board 604 may be implemented, for example, when the vehicle control modules 504 are omitted, such as for a sea container implementation.

A control module 612 is disposed on the expansion board 604. The control module 612 communicates with various input and output (I/O) devices 616. For example, examples of the input devices include pressure and temperature sensors of the system configured to measure pressures and temperatures, respectively, at various locations. Other examples of input devices include switches (e.g., control panel safety switches, high and/or low pressure cut out switches, etc.) and other types of input devices. Examples of output devices one or more fans of the system, one or more contactors of the system, one or more valves (e.g., expansion valves) of the system, and other types of output devices. The control module 620 may control operation and actuation of the output devices, such as a speed of the fan(s), opening/closing of the contactor(s), and actuation of the valve(s). The control module 612 communicates received parameters and output parameters (e.g., states) to other modules (e.g., the control module 260) via the network bus.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A system, comprising:

a refrigerant compressor including an electric motor;

a single printed circuit board (PCB);

a drive that is disposed on the single PCB and that includes switches that control the application of power from a battery to the electric motor;

one or more processors disposed on the single PCB, the one or more processors configured to:

determine a speed command for the refrigerant compressor based on one or more operating parameters; and actuate the switches of the drive based on the speed command; and a first interface disposed on the single PCB, the first interface having a plurality of input and output pins, the first interface being one of a male type interface and a female type interface, the first interface configured to receive first power from the battery via a first one of the input pins, to receive a second power from the battery via a second one of the input pins, to be connected to a network bus, to receive the one or more operating parameters via the network bus, and to receive an output of an ignition sensor that indicates whether a vehicle is ON or OFF via a third one of the input pins.

2. The system of claim 1 wherein the one or more processors are further configured to communicate via the network bus and the first interface using the Society of Automotive Engineers (SAE) J1939 communication standard.

3. The system of claim 1 wherein the one or more operating parameters include at least one of (a) a temperature of the system measured by a temperature sensor and (b) a pressure of the system measured by a pressure sensor.

4. The system of claim 1 wherein the one or more processors are further configured to actuate an actuator of the system via the network bus and the first interface.

5. The system of claim 4 further comprising a control module that is not disposed on the single PCB, that is configured to communicate via the network bus, and that is configured to actuate the actuator in response to receipt of signals from the one or more processors via the network bus.

6. The system of claim 5 wherein the actuator is one of a solenoid, a switch, a damper, a blower, an electronic expansion valve, and a fan.

7. The system of claim 1 wherein one or more processors and the drive do not communicate using the MODBUS communication protocol.

8. The system of claim 1 wherein the system is configured to cool a passenger cabin of a vehicle.

9. The system of claim 1 further comprising:

a second single PCB that is separate from the single PCB;

a second interface disposed on the second single PCB; and a control module disposed on the single PCB, the control module configured to:

receive input from one or more input devices via the second interface;

control one or more output devices via the second interface; and connect to a network bus via the second interface.

10. The system of claim 9 wherein the control module and the one or more processors are configured to communicate via the network bus.

11. The system of claim 10 wherein the control module and the one or more processors are configured to communicate via the network bus using the Society of Automotive Engineers (SAE) J1939 communication standard.

12. A single printed circuit board, comprising:

a drive that is disposed on the single PCB and that includes switches configured to control the application of power from a battery to an electric motor of a refrigerant compressor of a cooling system;

one or more processors disposed on the single PCB, the one or more processors configured to:

determine a speed command for the refrigerant compressor based on one or more operating parameters;

actuate the switches of the drive based on the speed command; and an interface disposed on the single PCB, the interface having a plurality of input and output pins, the interface being one of a male type interface and a female type interface, the interface and configured to receive a first power from the battery via a first one of the input pins, to receive a second power from the battery via a second one of the input pins, to be connected to a network bus, to receive the one or more operating parameters via the network bus, to receive an output of an ignition sensor that indicates whether a vehicle is ON or OFF via a third one of the input pins.

13. A method, comprising:

by one or more processors disposed on a single printed circuit board (PCB), determining a speed command for a refrigerant compressor based on one or more operating parameters;

by the one or more processors, actuating switches of a drive based on the speed command, wherein the drive is disposed on the single PCB and includes the switches, wherein the switches are configured to control the application of power from a battery to an electric motor of the refrigerant compressor of a cooling system;

by an interface disposed on the single PCB and having a plurality of input and output pins, receiving a first power from the battery via a first one of the input pins, the interface being one of a male type interface and a female type interface;

by the interface, receiving a second power from the battery via a second one of the input pins;

by the interface, receiving an output of an ignition sensor that indicates whether a vehicle is ON or OFF via a third one of the input pins;

by the one or more processors, communicating via a network bus via the interface; and by the one or more processors, receiving the one or more operating parameters via the network bus and the interface.

14. The method of claim 13 wherein the communicating includes, by the one or more processors, communicating via the network bus using the Society of Automotive Engineers (SAE) J1939 communication standard.

* * * * *